US007462001B2

(12) United States Patent
Canteri

(10) Patent No.: US 7,462,001 B2
(45) Date of Patent: Dec. 9, 2008

(54) METHOD FOR REPAIRING, WATERPROOFING, INSULATING, REINFORCING, RESTORING OF WALL SYSTEMS

(75) Inventor: Carlo Canteri, Bosco Chiesanuova (IT)

(73) Assignee: Uretek S.r.l., Bosco Chiesanuova (IT)

( * ) Notice: Subject to any disclaimer, the term of this patent is extended or adjusted under 35 U.S.C. 154(b) by 78 days.

(21) Appl. No.: 10/534,501

(22) PCT Filed: Aug. 7, 2003

(86) PCT No.: PCT/EP03/08790

§ 371 (c)(1),
(2), (4) Date: May 10, 2005

(87) PCT Pub. No.: WO2004/027177

PCT Pub. Date: Apr. 1, 2004

(65) Prior Publication Data

US 2006/0010826 A1 Jan. 19, 2006

(30) Foreign Application Priority Data

Sep. 19, 2002 (IT) ..... MI02A1995

(51) Int. Cl.
*E04G 23/02* (2006.01)
*C09K 17/00* (2006.01)
*E02D 3/12* (2006.01)

(52) U.S. Cl. ..... 405/267; 405/263; 405/266; 52/742.13; 52/742.14

(58) Field of Classification Search ..... 405/258.1, 405/263, 264, 266, 270, 271, 269; 527/742.13, 527/742.14
See application file for complete search history.

(56) References Cited

U.S. PATENT DOCUMENTS

| | | | | |
|---|---|---|---|---|
| 2,627,169 | A * | 2/1953 | Poulter | 405/267 |
| 3,719,050 | A * | 3/1973 | Asao et al. | 405/264 |
| 3,878,686 | A * | 4/1975 | Hageman et al. | 405/264 |
| 4,103,464 | A * | 8/1978 | Clifft et al. | 52/127.4 |
| 4,114,382 | A * | 9/1978 | Kubens et al. | 405/264 |
| 4,116,014 | A * | 9/1978 | Satterwhite | 405/179 |
| 4,272,935 | A * | 6/1981 | Lukas et al. | 52/309.11 |
| 4,307,980 | A * | 12/1981 | Meyer et al. | 405/264 |
| 4,391,926 | A * | 7/1983 | Creyf | 523/132 |
| 4,452,551 | A * | 6/1984 | Arndt et al. | 406/264 |
| 4,454,252 | A * | 6/1984 | Meyer | 521/110 |

(Continued)

FOREIGN PATENT DOCUMENTS

DE C-196 53 282 4/1998

(Continued)

*Primary Examiner*—Tara L. Mayo
(74) *Attorney, Agent, or Firm*—Modiano & Associati; Albert Josif; Daniel J. O'Byrne

(57) ABSTRACT

A method for repairing and/or waterproofing and/or insulating and/or reinforcing and/or restoring the structural integrity of wall systems, which it consists in providing spaced injection holes within a wall system in a manner suitable to pass through cavities that exist in the wall system, inserting injection tubes in these holes, and then inserting a substance that expands after injection as a consequence of a chemical reaction so that the substance reaches the cavities connected to the injection holes or are proximate thereto, the injection tubes being, preferably gradually retracted along the injection holes in the opposite direction with respect to insertion, to allow the substance diffusing in cavities crossed by the injection holes or proximate thereto.

37 Claims, 4 Drawing Sheets

U.S. PATENT DOCUMENTS 4,475,847 A * 10/1984 Cornely et al. ..... 405/264
4,563,852 A * 1/1986 Achtenberg et al. ..... 52/742.14
4,567,708 A * 2/1986 Haekkinen ..... 52/742.13
4,575,391 A * 3/1986 DeBoodt et al. ..... 71/28
4,715,746 A * 12/1987 Mann et al. ..... 405/264
4,744,700 A * 5/1988 Andy et al. ..... 405/264
4,761,099 A * 8/1988 Mann et al. ..... 405/264
4,832,535 A * 5/1989 Crambes ..... 405/266
4,904,125 A * 2/1990 Schmidt et al. ..... 405/264
5,306,104 A * 4/1994 Witherspoon ..... 405/263
5,401,121 A * 3/1995 Nakashima et al. ..... 405/269
5,436,396 A * 7/1995 Bailey et al. ..... 523/130
5,655,350 A * 8/1997 Patton ..... 52/742.13
6,052,964 A * 4/2000 Ferm et al. ..... 52/742.14
6,309,493 B1 10/2001 Dobrez-Florez et al. ..... 156/94
6,430,889 B1 * 8/2002 Nixon, Sr. ..... 52/656.4
6,662,516 B2 * 12/2003 Vandehey et al. ..... 52/407.1

FOREIGN PATENT DOCUMENTS

DE A-199 28 339 1/2001
WO WO9824982 A1 * 6/1998

* cited by examiner

METHOD FOR REPAIRING, WATERPROOFING, INSULATING, REINFORCING, RESTORING OF WALL SYSTEMS

The present invention relates to a method for repairing and/or waterproofing and/or insulating and/or reinforcing and/or restoring the structural integrity of wall systems. In particular, the method according to the invention is capable of increasing the mechanical strength of a wall system and/or of decreasing its permeability to flows of water and/or of reducing its thermal conductivity and/or other properties and can be performed even in the presence of water.

BACKGROUND OF THE INVENTION

Walls or wall systems that constitute buildings are generally produced by superimposing or arranging side by side blocks of stone or brick or other materials, with the interposition of a binder based on lime or cement or other binding materials, without the presence of voids or cavities.

Usually design sizing of such buildings is carried out in fact by considering the entire cross-section of the wall system as reactive, i.e., it is assumed that all of the cross-section of the masonry is involved in the support of the overlying loads; in other words, the presence of voids or cavities inside the wall system is excluded. In terms of strength, the design takes into account an allowable tension for the masonry that is determined by the contribution provided by the strength of the block of brick or stone or other material and by the contribution provided by the strength of the binder used, also by means of laboratory tests.

Once the building has been completed, as time goes by, the bed of binder that is interposed between the blocks or part of the blocks themselves can be disaggregated by the surrounding action produced by water or air or other agents, or can be conveyed elsewhere by filtering streams or can be altered by the chemical action induced by various phenomena, including atmospheric ones.

This reduction of material within the wall cross-section causes the presence of voids of various sizes, with a consequent net reduction of the effective resisting cross-section, a reduction in the allowable tension or an increase in permeability and other effects.

In some cases, this reduction in strength can cause the collapse of the building.

In other cases, entirely intact wall systems which however contain voids might no longer perform their function correctly because they are subjected to boundary or limit conditions that were not planned for during design, such as for example the generation of tensions affecting the wall system with a different intensity or direction with respect to the design, or the presence of fluid adjacent to the walls of the wall systems, with consequent filtering motions between the blocks, or the need for greater thermal insulation on the part of the wall system, or the need to improve the cohesion of the wall structure, or other conditions.

Various systems are known for ensuring in any case the securing of the masonry and its regeneration. These are generally systems that tend to rebuild the wall body by means of so-called "stitch and unstitch" operations, i.e., delicate operations that consist in partial removals of deteriorated bodies, combined with temporary supports of the complementary masonry with auxiliary structures such as props, boards, ties, or others and the complete replacement of the removed parts. This method, in addition to being highly invasive, requires very long execution times and very high costs.

Other wall consolidation systems are known which consist in "choking", or "hooping", or the like, the deteriorated masonry. These systems provide for the aid of auxiliary elements to ensure the recovery of the strength of the wall body, such as for example props, ribs, bars or others. These methods, in addition to being highly invasive, modify the original structure and geometry of the wall body, introducing new metallic elements or others that remain visible to the observer. The costs for the application of these methods are generally very high.

Moreover, other systems are known which provide for the injection, horizontally or in any case at right angles to the two larger opposite faces, in the wall system, of cement or chemical mixtures, possibly with additives, in order to fill the voids that have formed. The injections performed horizontally and at right angles to the surface of the wall, in order to ensure that all the voids are reached, must be very numerous, also for the reasons that will become better apparent hereinafter, and therefore the procedure becomes long and onerous. Moreover, the mixtures used, which generally do not expand or have extremely low degrees of expansion, are injected at low pressure by using electric pumps or other devices or by gravity, most of all to avoid the risk of damaging the walls irreversibly. In the methods described above, therefore, a non-expanding or low-expanding material is used which, again to avoid damaging the wall system irreversibly, has a negligible expansion force (which may even not be known) that is most of all uncontrolled and impossible to dissipate.

For all of these reasons, with these methods it is very difficult to ensure both the filling of the all the voids, including the ones located furthest from the injection point, and the complete filling of vertically extended cavities. Finally, indeed because of the cited characteristics, these methods are unable to induce in the masonry a state of tension whereby the mechanical characteristics of the wall system are improved considerably with respect to the situation prior to the intervention.

SUMMARY OF THE INVENTION

The aim of the present invention is to provide a method that allows to repair and/or waterproof and/or insulate and reinforce and/or restore the structural integrity of wall systems effectively and durably and with execution costs that are distinctly lower than those of the systems currently in use.

Within this aim, an object of the invention is to provide a method that can be adopted without problems even if the wall system or part thereof is immersed in water.

Another object of the invention is to provide a method that does not require the complete replacement of the elements that constitute the deteriorated wall system and does not provide for the use of auxiliary structures, including visible ones, suitable to increase the allowable strength of the system or the resisting cross-section of said masonry or decrease its permeability.

Another object of the invention is to provide a method that is simple and rapid to perform, ensures the safety of the building during and after the execution of the method, allows to reconstitute the structural integrity of the wall system, and ensures a distinct decrease in the permeability of the wall system and/or ensures a reduction in its thermal conductivity.

This aim and these and other objects that will become better apparent hereinafter are achieved by a method for repairing and/or waterproofing and/or insulating and/or reinforcing and/or restoring the structural integrity of wall systems, characterized in that it consists:

in providing spaced injection holes within a wall system in a manner suitable to pass through cavities that exist in the wall system;

in inserting injection tubes in said injection holes;

in injecting in said injection holes, through said injection tubes, a substance that expands after injection as a consequence of a chemical reaction.

BRIEF DESCRIPTION OF THE DRAWINGS

Further characteristics and advantages of the invention will become better apparent from the description of a preferred but not exclusive embodiment of the method according to the invention, illustrated only by way of non-limitative example in the accompanying drawings, wherein.

DESCRIPTION OF THE PREFERRED EMBODIMENTS

Figure 1:
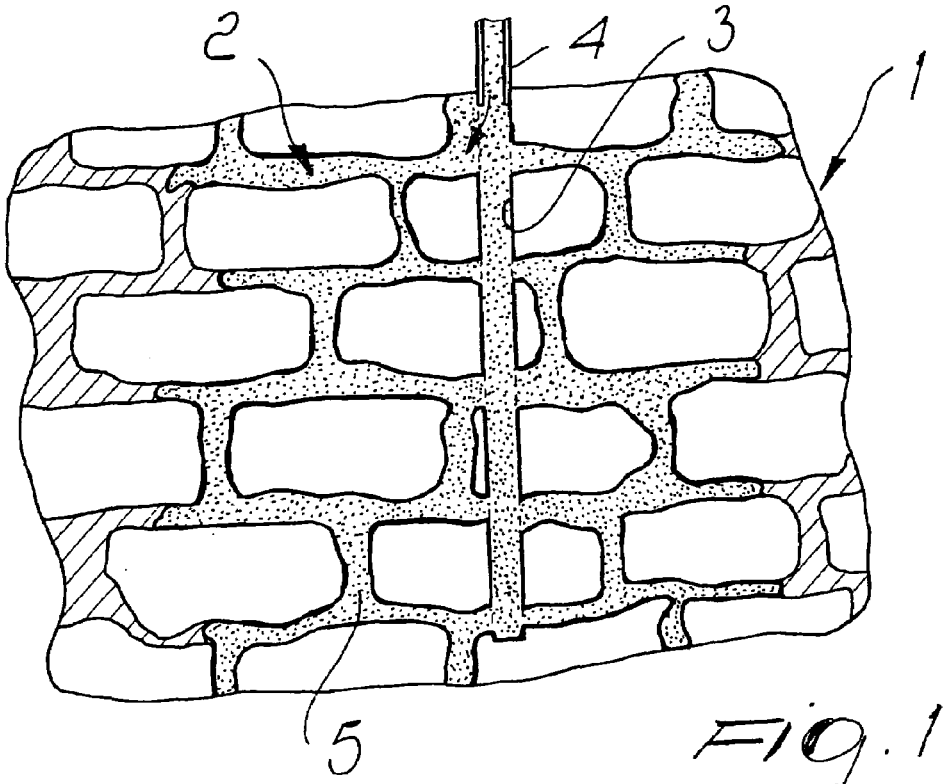
FIG. 1 is a schematic view showing injection of the expanding substance through an injection hole formed in a wall system.

With reference to the cited figures, the method according to the invention substantially consists in producing, in a wall system 1 that contains voids or cavities 2, injection holes 3 which are spaced and whose number varies according to the requirements and the conditions of deterioration of the wall system 1.

The injection holes 3 preferably run along directions that are substantially perpendicular to the surface of maximum extension of the cavities 2 inside the wall system 1.

If, as occurs more frequently, the wall system 1 is extended vertically, the injection holes 3 are preferably produced with a direction that is vertical or slightly inclined with respect to the vertical, since, as it has been assessed, the larger cavities 2 inside the wall system 1 are generally arranged horizontally (for example a wall of bricks), so as to be able to pass through the largest possible number thereof with every single injection hole 3. Said injection holes 3 can be provided directly in the wall system 1, selectively, with different lengths according to the specific requirements established on the basis of previous study of the structure and preferably with a distance between two contiguous injection holes that can vary between 0.20 and 2.00 m.

The injection holes 3 can have variable dimensions according to the specific requirements, in any case with a diameter preferably comprised between 4 mm and 40 mm. In some cases it may be necessary to provide the injection holes 3 in a direction other than vertical but in any case between the planes of arrangement of the two larger opposite faces of the wall system 1.

The depth of the injection holes 3 also can vary according to the specific requirements, as will become better apparent hereinafter.

Injection tubes 4 are then inserted or driven into the injection holes 3; said tubes are made of copper, PVC, steel or other material, and are suitably constituted by and/or treated with lubricating material in order to facilitate their sliding along the corresponding injection hole 3.

Then a selected substance 5, called hereinafter "substance" that expands after injection by chemical reaction is injected through the injection tubes 4 into the wall system 1.

Preferably, during the injection the injection tubes 4 are gradually retracted along the corresponding injection hole 3 in the opposite direction with respect to the direction of insertion, so that the substance 5 distributes in the plurality of cavities 2 that the injection hole 3 passes through or are connected thereto, with the purpose of involving, with a single operation, a vast volume of wall system 1 and of filling with the substance 5 a plurality of voids, interstices and cavities.

In the most frequent case of a wall system 1 that is extended vertically and therefore has injection holes 3 that run vertically or are slightly inclined with respect to the vertical, the injection tubes 3 are gradually retracted upward, during the injection of the substance 5, at a rate that is preferably variable, as will become better apparent hereinafter.

The selected substance 5, once injected, as a consequence of a chemical reaction among its components, expands with a potential volume increase comprised between 2 and 5 times the volume of the substance before expansion and generates a maximum expansion pressure in conditions of complete confinement that is normally comprised between 20 kPa and 200 kPa, and is in any case selected to be always lower than the bursting limit pressure of the wall system 1 being treated.

The maximum expansion pressure of said substance 5, as it has been established by way of studies carried out while devising the present method, greatly decreases for a minimal increase in volume of said substance as a consequence of the chemical reaction, and so as to ensure, if completely confined within a saturated wall cavity, a considerable reduction of the expansion pressure after minimal expansion and therefore after any minimal and tolerable deformations of the surrounding wall elements. In particular, it has been established that said substance has a strong reduction in maximum expansion pressure following an expansion thereof of even less than 5% of its initial volume. The term "dissipable" used in the present document, in this connection, is intended to express the mentioned concept.

The used, selected substance 5, before expansion, has a permeability coefficient preferably equal to 10-9 m/s.

The substance 5 has, before the beginning of the chemical expansion reaction, an average viscosity comprised between 200 mPa·s and 300 mPa·s at 20° C. and in any case suitable to ensure the easy permeation of the cavities that can be reached by it as its exits from the injection tube 4 in the wall system 1.

The substance 5 has a reaction time, i.e., the time interval between its introduction in the injection tube 4 and the beginning of the expansion process, that is normally comprised between 3 seconds and 60 seconds so as to avoid, depending on the thickness and characteristics of the wall system 1 to be subjected to the intervention, both an excessive escape of the substance 5 from the treated masonry and a partial permeation of the voids that are present inside the wall system 1.

Directly after the beginning of the expansion process, the substance 5 rapidly increases its viscosity until it becomes solid, i.e., with a viscosity that tends to infinity, once the reaction has ended; this time period is preferably comprised between 20 and 150 seconds.

This characteristic is very important, also because it allows to inject the substance 5 even into wall systems in direct contact with moving water without the risk of washing it away and therefore conveying it out of the wall system. Moreover, said substance 5 is capable of performing regular expansion regardless of the presence of surrounding water.

Once it has expanded and consolidated, the substance 5 cannot be altered by the presence of water, even if said water contains acids and/or rich in sulfates and/or carbonates and/or salts in general.

Once consolidation has occurred, the substance 5 has good mechanical characteristics, at least equal to those of the disaggregated material that the substance 5 has replaced. These mechanical characteristics can be defined beforehand, within a certain margin, since they depend on the density of said substance 5 after expansion, which is directly a function of the density of the substance 5 expanded in free air and of the amount of substance introduced during the injection step.

In particular, said substance 5, once it has consolidated, preferably, is selected so as to have a tensile strength substantially between an average of 180 $N/cm^2$ at a density of 200 $kg/m^3$ and 800 $N/cm^2$ at a density of 500 $kg/m^3$, and a compression strength substantially between an average of 200 $N/cm^2$ at a density of 200 $kg/m^3$ and 1300 $N/cm^2$ at a density of 500 $kg/m^3$, a property whereby it improves the mechanical characteristics of the treated wall system 1 even with respect to its original conditions, especially if one considers that usually the density of the injected and consolidated substance 5 is higher than 500 $kg/m^3$ and therefore its tensile strength and compression strength are even higher than indicated above, while the tensile strength of conventional binders is practically zero.

The substance 5, once it has expanded and consolidated, has a lower relative density than water.

The selected substance 5 is conveniently constituted by a mixture of expanding polyurethane foam, preferably a closed-cell polyurethane foam. Said substance 5 can be constituted, for example, by a two-part (component) foam that is mixed inside a mixing unit of a known type, not shown for the sake of simplicity, which is connected to the injection tubes 4 and is served by a pump that ensures the pressure required to inject the substance through the injection tubes 4. The first component can be a mixture of polyols comprising a polyether polyol, a catalyst and water, such as that available under the name Uretek Hydro CP 200 A manufactured by the Dutch company Resina Chemie. The second component can be an MDI isocyanate, such as that available under the name Uretek Hydro CP 200 B manufactured by the same company. The mixing of these two components produces an expanding polyurethane foam whose density, at the end of expansion in free air (i.e., without confinement), is at least equal to 200 $kg/m^3$ and varies according to the volume of the cavities 2 that are present in the wall system 1 and to the resistance opposed by the walls that delimit said cavities 2.

Clearly, it is also possible to use other expanding substances that have similar properties without thereby abandoning the scope of the protection of the present invention.

Figure 2:
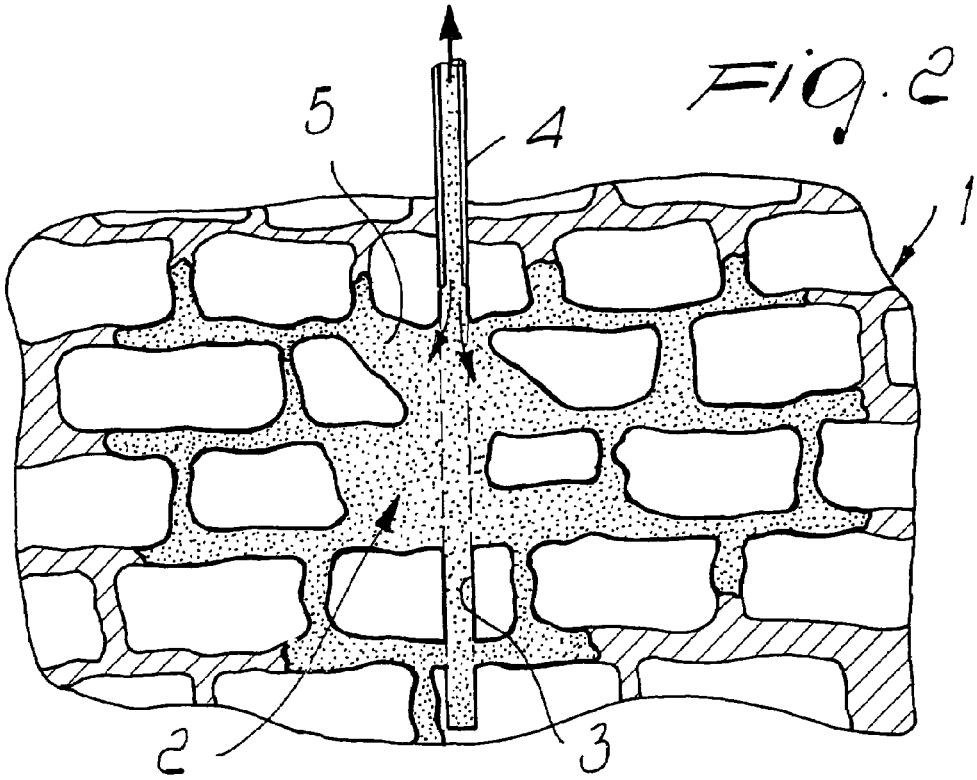
FIG. 2 is a schematic view illustrating the result of the expansion and consolidation of the expanding substance if it is injected while the injection tube is gradually retracted upward along the corresponding injection hole.
Figure 4:
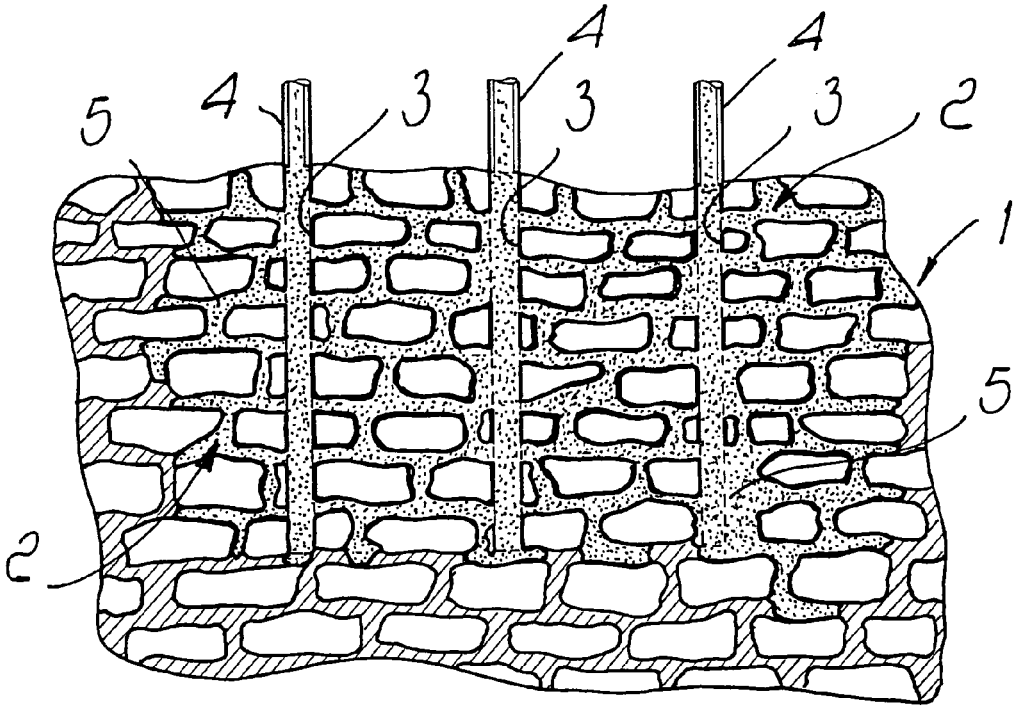
FIG. 4 is a view illustrating the result of the expansion of the injected substance in the case of injections in multiple injection holes formed along the extension of a fractured wall system.

According to the requirements, the substance 5 can be injected, through the injection tubes 4 inserted in the injection holes 3, formed beforehand in the wall system 1, in a single injection step or, selectively, with partial interruptions, as shown in FIGS. 1, 2 and 4, starting from below, while the injection tube 4 is gradually retracted upward at a rate that is preferably adjusted according to the pressure and/or flow-rate of injection of the substance 5.

Figure 3:
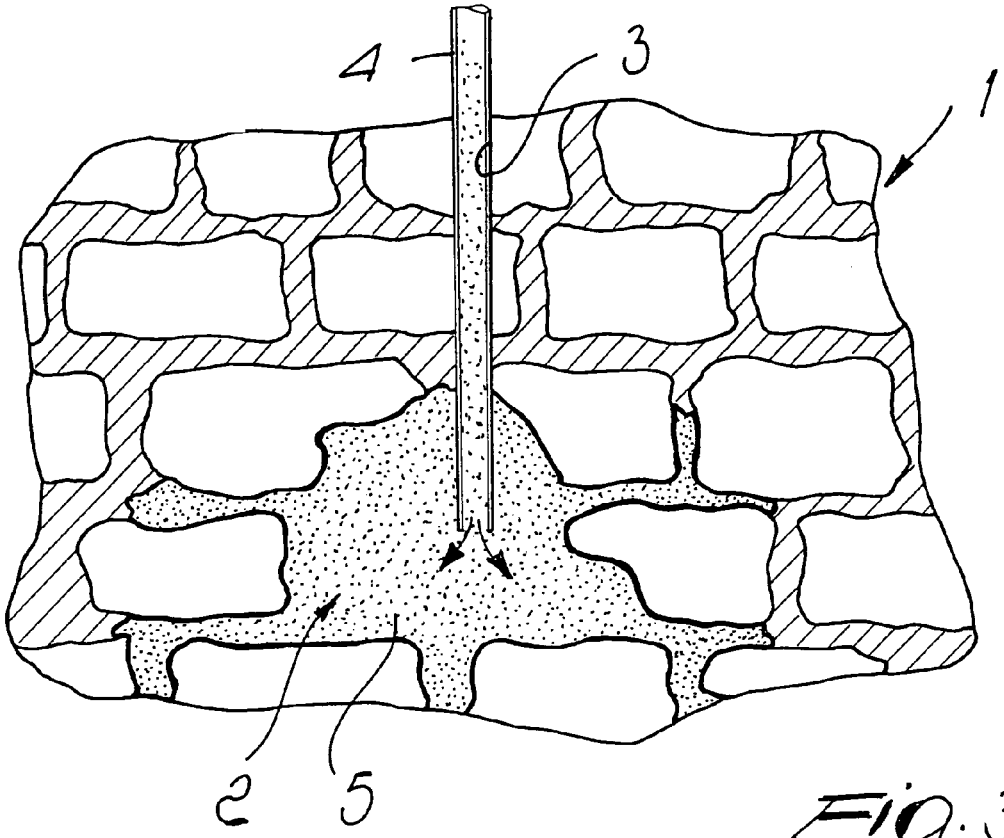
FIG. 3 is a schematic view illustrating the result of the expansion and consolidation of the expanding substance if it is injected without retracting the tube.

If necessary, the substance 5 can also be introduced selectively by performing localized injections in specific points of the wall system 1 selected by appropriate engineering criteria, for example, where there is a greater presence of voids or where there are water infiltrations, or where there is a structural discontinuity or other condition. In this last case, the injection tubes 4 are not necessarily retracted but can be left inside the wall system 1, as shown in FIG. 3. In this case also, it can be useful to measure the pressure and/or flow-rate of injection of the substance 5 in order to check that the cavities 2 are filled completely and therefore decide to interrupt the injection.

The pressure and flow-rate of injection can be measured constantly by means of a monitoring system that comprises a pressure gauge and/or a flow-rate measurement device 6 of a known type, which are shown schematically for the sake of simplicity and are arranged upstream of the inlet of the injection tube 4 between said inlet and the mixer, for example on an injection nozzle 7, of a known type, of an injection device 8, that connects the mixer to the corresponding injection tube 4, so as to achieve complete filling of the cavities 2 before starting the retraction of the injection tube 4 or interrupting the injection of the substance 5.

In particular, an example is given of the importance of the use of injection monitoring by means of the instruments 6 cited above arranged on the injection nozzle 7. This example is given merely by way of non-limitative indication: assuming that the characteristics of the intact wall system are already measured and known, so that the maximum pressure that can be withstood by the masonry, i.e., the limit bursting pressure (20 bar) divided by the safety coefficient (10), is 2 bar, the injection process is selectively performed by limiting the injection pressures in the steady state between 0 and 2 bar.

As the injection pressures measured by the pressure gauge 6 vary, the retraction rate of the injection tube 4 varies proportionally.

When the pressure measured by the pressure gauge located on the injection nozzle is 0 bar, the injection tube 4 is retracted at the rate of 0 meters per minute; when the pressure measured by the pressure gauge located on the injection nozzle tends to, but is in any case lower than, 2 bar, the injection tube 4 is retracted at the rate of 3 meters per minute; when the pressures measured by the pressure gauge located on the injection nozzle are between 0 and 2 bar, the retraction rate of the injection tube 4 varies proportionally between 0 and 3 meters per minute. The parameters described above, by way of example, can be varied even considerably as a function of the characteristics of the wall system 1 that vary.

If a prolonged induction of overpressure occurs suddenly and instantaneously and is measured by the pressure gauge 6 located on the injection nozzle up to 10 bar (a value that is in any case lower than the bursting limit pressure of the masonry) and/or if a substantial decrease or stoppage in delivery measured by the flow-rate measurement device occurs, a safety valve 12 or the like stops the injection stream through the feeding tube 14 that exits from the injection nozzle, deactivating the system and therefore the injection of the substance 5. The induction of overpressure must be prolonged and must last generally between 2 and 10 seconds, depending on the type of masonry. For very rapid overpressure peaks (generally shorter than 2-10 seconds), it has been observed that the masonry is in any case capable of tolerating certain pressures, which are in any case lower than the bursting limit pressure, without necessarily undergoing deformation. In some cases, moreover, the occurrence of overpressure peaks helps to achieve more complete permeation of the voids on the part of the substance 5 in the wall system. It has been established that for substances whose viscosity is higher than the preferred viscosity cited above, the induction of overpressure produces very small benefits of higher permeation, offset by high risks of bursting the wall system.

In the manner described, maximum safety is ensured and risks of collapse of the wall system are avoided, ensuring complete permeation thereof.

The flow-rate measurement device and the pressure gauge furthermore allow to manage the injection, avoiding excessive outflows of the substance 5 from the wall system 1; if the dispensed flow-rate is excessively high, the injection can in fact be interrupted, checking the wall system visually or with destructive or non-destructive tests in order to determine whether there are excessive dispersions of the substance 5 outside the wall system 1.

This selectable system to be used to control continuously the injection and retraction rate of the injection tubes 4 can be of the programmable type, so that it can be applied to wall systems that have different characteristics.

The injection tubes 4 have, at one of their axial ends, an inlet that is designed to be connected to the injection nozzle 7 and, at or proximate to their opposite axial end, one or preferably a plurality of outlets 9 for the substance 5. In the case of multiple outlets, the sum of the individual passage sections of said outlets is preferably larger than the passage section of the inlet to which the injection nozzle is applied. This characteristic produces, among other effects, a greater uniformity of distribution of the substance 5 in the wall system 1, a lower risk of sudden increases in pressure caused by obstruction of the injection duct, constituted by the injection tube 4 and/or by the injection hole 3, or by the filling of sealed cavities present in said wall system and a reduction in the outflow rate of the substance 5 from the injection duct, with a consequent reduction of the risk of escape from the wall system 1.

Once injected, solely with the pressure induced by the pump, the substance 5, owing to its low viscosity (whose preferred values are cited above) tends to enter, before expansion, all the cavities 2 that are more easily accessible in the wall system and expansion starts. This behavior causes the controlled filling of the occupied cavities 2 and propels the substance 5 further into the less accessible cavities, consequently filling them. The controlled and dissipable expansion pressure of the substance 5 avoids significant and dangerous breakages and deformations in the wall system 1. All the solid elements that constitute the wall system 1 that surrounds the injection hole are surrounded by a film of expanded substance whose dimensions are substantially equal to those of the preceding empty interstices, assuredly placed under tension again. Any fluids that are present in cavities of the wall system are expelled by the expansion pressure of the substance 5, and all the stone or brick blocks that constitute the solid skeleton of the wall system are reaggregated without being subjected to excessive tensions. If the wall system is immersed in water or in the ground below the water table level, an expanding substance is used which reacts independently of the presence of water and is not altered by it during the expansion process or after consolidation has occurred. For example, the mentioned Uretek Hydro CP 200A expands solely by virtue of the water contained therein, since it is a halogen and totally devoid of propellant compounds such as CFCs, HFCs, HCFCs and CFs. In other words, the chemical reaction of expansion occurs without absorbing water from the surrounding environment and therefore without being damaged by said water or most importantly boosted uncontrollably in its expansion force. Moreover, said element derives from renewable and non-polluting material.

It should be noted, according to the present invention, that the substance 5 injected into the wall system according to an appropriately designed geometric grid automatically seeks the cavities 2 that are easier to reach during expansion. In this manner, the substance continues to occupy the cavities until they are saturated, consequently causing an overpressure and a reduction in flow-rate, which can be verified at all times by the monitoring system located at the injection nozzle as described above.

Another monitoring operation that can be performed during use is the monitoring of any movements, along directions that are substantially perpendicular to the planes of arrangement of the two larger opposite faces of the wall system and therefore horizontally, if the wall system is vertical, undergone by the wall system or by the entire outer surface of the wall system during the injection of the substance 5. This monitoring is optionally performed by using laser levels or similar instruments that are commercially available and are suitable to detect in real time and continuously any minimum movement of the surfaces of said wall system.

Figure 6:
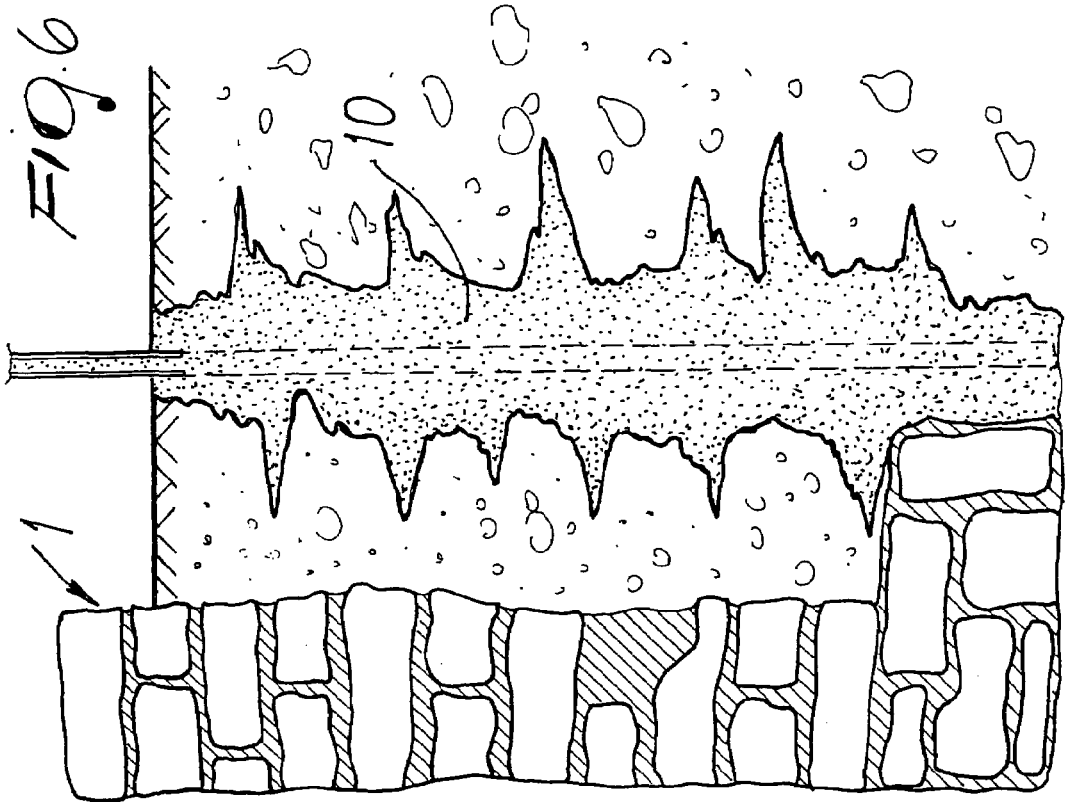
FIGS. 5, 6 and 7 are views illustrating treatment methods prior to injection if the wall system has large cavities that lead to the outside of the wall system.
Figure 5:
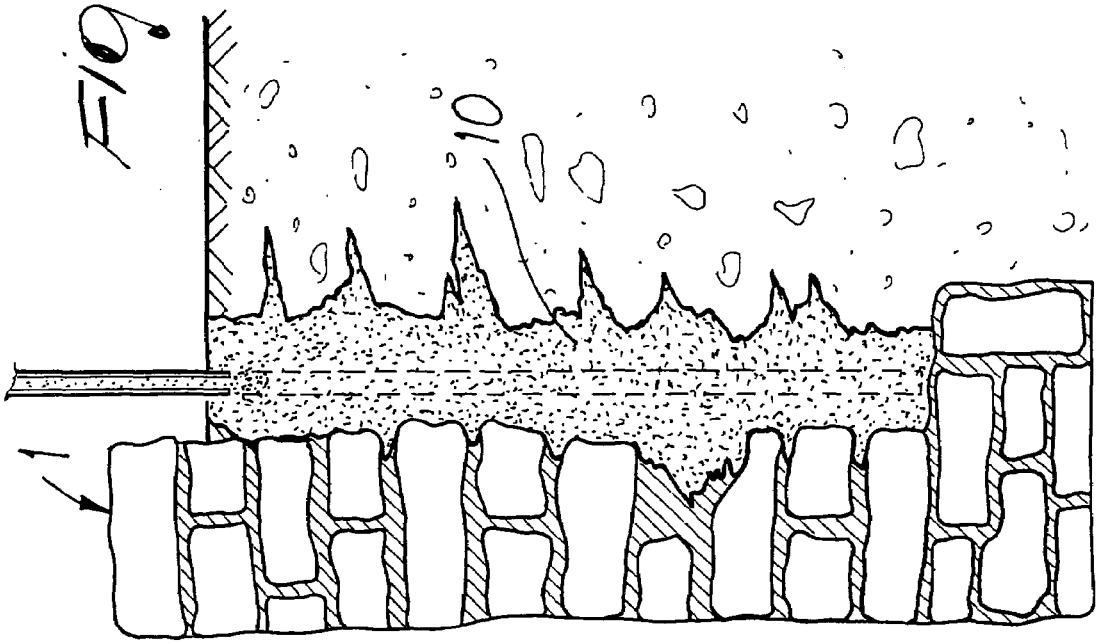
Figure 7:
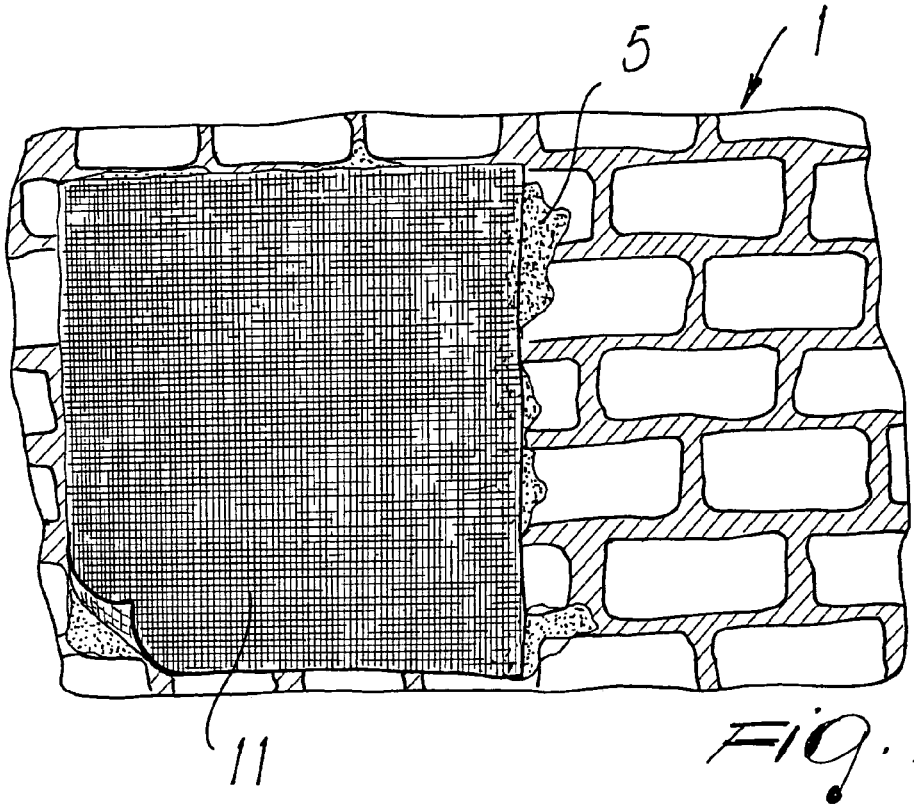

In the presence of large or in any case appreciable cavities in the wall system that rise to the surface, it is possible to perform interventions prior to the injection of the substance 5 into the wall system. These interventions differ depending on whether the surface of the wall system is in contact with the ground or is exposed, i.e., its surface is free or immersed in water. In the first case it is possible to act beforehand, according to a known type of technique, with injections of expanding substances 10 that have a high degree of expansion and a great expansion pressure along the surface of the wall system directly in contact with the ground, or in the ground at a distance that can vary from 0.20 m to 1.00 m from the surface, as shown in FIGS. 5 and 6, in order to push the soil or the injected expanding system toward the cavities of the wall system in order to close and block the openings that are present therein and rise to the surface. In the second case, it is possible to act along the surface of the wall system affected by the surfacing of the cavities, for example by applying a sheet of geotextile material 11 or other material and by "spray" covering it by using expanding substances with a high degree of expansion and rapid hardening, as shown in FIG. 7. All this can be removed rapidly immediately after the operation for injection into the wall system. To achieve the goal of confinement of the wall system, it is optionally possible to use other methods, so long as they are capable of confining any escape of the substance 5 from the cavities that reach the surface of the wall system.

Figure 8:
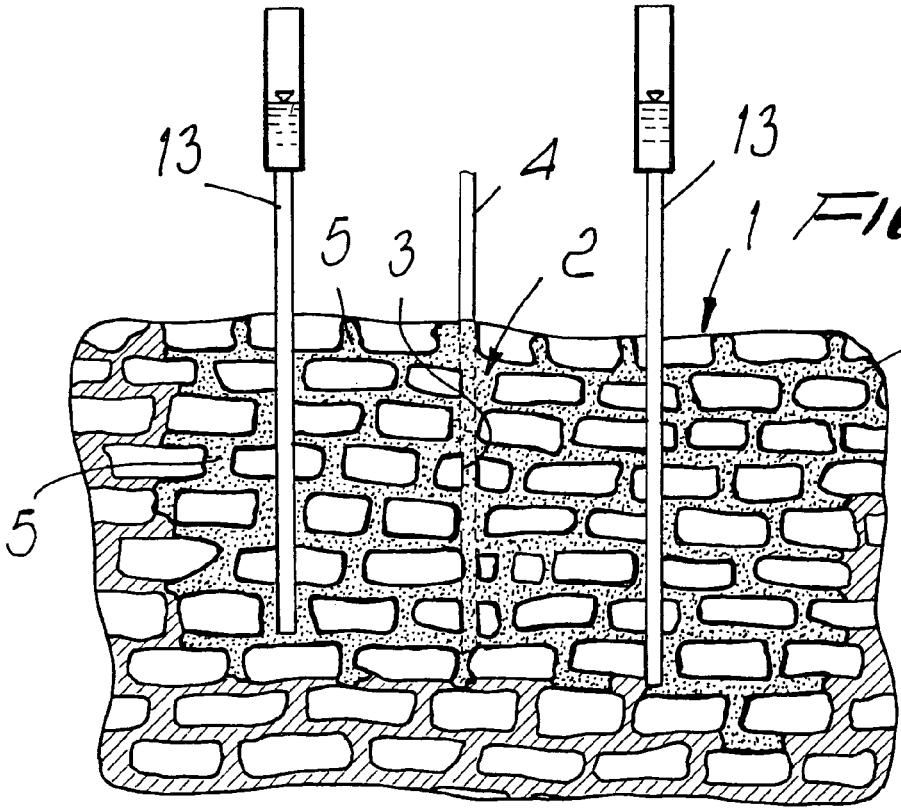
FIG. 8 is a view illustrating the monitoring of the injection achieved by introducing in the wall system piezometer pipes filled with water.

In order to define precisely the center distance for performing the injections in the masonry, it is possible to use the system shown in FIG. 8, i.e., the method of monitoring the injection performed by introducing closed-end flexible and deformable piezometer pipes 13 into measurement holes 15 made in the wall system 1 in the vicinity of the injection tube 4. Said piezometer pipes 13 are filled with water, and the level of the water is visible in the portion of the piezometer pipes 13 that protrudes upward from the wall system 1. The substance 5, during the filling of the cavities 2 that contain the piezometer pipes 13, by way of its expansion pressure, presses the walls of the piezometer pipes 13, causing the rise of the level of the water contained therein. This non-destructive monitoring allows to identify the space covered by the expanding substance inside the wall system and to design accordingly the center distance of intervention required to consolidate said wall system.

This non-destructive monitoring system can be used systematically during the injection operations where it is important to check that the wall system has been permeated by the substance 5 in every cavity.

At the end of the treatment, it is possible to apply to the wall system conventional integrity testing methods, either destructive ones such as coring or others or non-destructive ones such as ultrasound testing or others.

In practice it has been found that the method according to the invention fully achieves the intended aim, since it allows, in a simple, rapid, effective, permanent, non-destructive and low-cost manner, to restore the structural integrity of deteriorated wall systems, even in the presence of water, in order to increase their mechanical characteristics, reduce their permeability to water flows, reduce their thermal conductivity, and other effects.

The method thus conceived is susceptible of numerous modifications and variations, all of which are within the scope of the appended claims; all the details may further be replaced with other technically equivalent elements.

The disclosures in Italian Patent Application No. MI2002A001995 from which this application claims priority are incorporated herein by reference.

What is claimed is:

1. A method for repairing and/or waterproofing and/or insulating and/or reinforcing a wall system by restoring the structural integrity thereof, the wall system comprising a solid aggregate structure consisting of blocks of material with a binder interposed therebetween, the solid structure extending between planes of arrangenment of opposite surfaces thereof, the method consisting:

in locating cavities that exist and are formed in said solid structure by disaggregation of the block material or binder;

in providing spaced injection holes within said wall system in a manner suitable to pass through said cavities that exist in the solid structure;

in inserting injection tubes in said injection holes;

in injecting in said injection holes, through said injection tubes, a substance that expands after injection as a consequence of a chemical reaction, fills said cavities and restores the structural integrity of the solid structure.

2. The method according to claim 1, wherein during injection said injection tubes are retracted gradually, in the opposite direction with respect to insertion, along the corresponding injection holes in order to allow said substance to penetrate the cavities crossed by, or proximate to, said injection holes.

3. The method according to claim 2, wherein said injection tubes are constituted by, or treated with, lubricating material in order to facilitate retraction thereof during injection of said substance.

4. The method according to claim 2, comprising during the injection of said substance, adjusting a rate of refraction of the injection tubes according to a pressure and/or flow-rate of injection of said substance.

5. The method according to claim 4, wherein the injection pressure is measured by way of a pressure gauge that is arranged upstream of the inlet of said injection tubes and is connected to the feeding tube for injection of said substance.

6. The method according to claim 4, wherein the injection flow-rate is measured by means of a flow-rate measurement device that is arranged upstream of the inlet of said injection tubes and is connected to the tube for feeding the injection of said substance.

7. The method according to claim 4, comprising detecting presence of said substance and the pressure applied thereby during expansion at regions of the solid structure of the wall system that are proximate to regions affected by the injection.

8. The method according to claim 7, comprising measuring the presence of said substance and the pressure applied thereby during expansion, in the regions of the solid structure of the wall system that are proximate to the regions affected by the injection, by way of piezometer pipes inserted in measurement holes provided in the wall system at preset distances from the injection holes in which said injection tubes are inserted.

9. The method according to claim 1, wherein said injection holes are formed substantially at right angles to the largest surface of the cavities inside the wall system.

10. The method according to claim 1, wherein said substance is constituted by a closed-cell polyurethane foam.

11. The method according to claim 1, wherein said substance is constituted by an MDI i.e. a methylene diphenyl diisocyanate and a mixture of polyols.

12. The method according to claim 1, wherein said substance has a maximum expansion pressure substantially comprised between 20 kPa and 200 kPa.

13. The method according to claim 12, wherein said substance has, during expansion, a reduction in the maximum expansion pressure upon a low increase in volume, i.e. a dissipation after a degree of expansion thereof that may be less than 5% of its initial volume.

14. The method according to claim 1, wherein said substance has a maximum expansion pressure that is lower than a bursting limit pressure of the solid structure of the wall system in which it is injected.

15. The method according to claim 1, wherein the reaction time of said substance is comprised between 3 and 60 seconds.

16. The method according to claim 1, wherein the chemical reaction for expansion of said substance and said substance during expansion remain non-altered by water presence.

17. The method according to claim 16, wherein said substance, once injected and hardened, has a lower relative density than water.

18. The method according to claim 1, wherein said substance, once expanded and consolidated, maintains a non-altered state in the presence of water, or water containing acid and/or water rich in sulfates and/or carbonates or salts in general.

19. The method according to claim 1, wherein said substance, once injected and hardened, has a tensile strength substantially comprised between an average of 180 $N/cm^2$ at a density of 200 $kg/m^3$ and 800 $N/cm^2$ at a density of 500 $kg/m^3$.

20. The method according to claim 1, wherein said substance, once injected and hardened, has a compression strength substantially comprised between an average of 200 $N/cm^2$ at a density of 200 $kg/m^3$ and 1300 $N/cm^2$ at a density of 500 $kg/m^3$.

21. The method according to claim 1, wherein said substance, prior to the beginning of the chemical reaction of expansion, has a viscosity substantially comprised between 200 mPa·s and 300 mPa·s at 20° C.

22. The method according to claim 21, wherein viscosity of said substance passes from a value of 200-300 mPa·s to a value that tends to infinity in a time interval comprised between 20 and 150 seconds starting from the beginning of the chemical reaction of expansion of said substance.

23. The method according to claim 1, wherein said injection holes are produced along substantially vertical directions, and in that said substance is injected through said injection tubes by gradually retracting said injection tubes upward.

24. The method according to claim 1, wherein said injection holes are produced along directions that are inclined with respect to the vertical and in that the injection through said injection tubes is performed while gradually retracting said injection tubes upward.

25. The method according to claim 1, wherein said injection holes are provided along a direction with a longitudinal extension that is contained between the planes of arrangement of two opposite faces of the wall system.

26. The method according to claim 1, wherein the distance between two contiguous injection holes is substantially comprised between 0.20 m and 2.00 m.

27. The method according to claim 1, wherein a diameter of said injection holes is substantially comprised between 4 mm and 40 mm.

28. The method according to claim 1, wherein said injection tubes have an inlet that is connected to an injection device and multiple outlets for passage of said substance.

29. The method according to claim 28, wherein the overall passage section of said outlets of said injection tubes is greater than the passage section of said inlet.

30. The method according to claim 1, comprising providing means for interrupting the injection of said substance.

31. The method according to claim 1, comprising constantly monitoring during the injection of said substance the movement of the solid structure of the wall system along directions that are substantially perpendicular to the planes of arrangement of two larger faces of the solid structure of the wall system.

32. The method according to claim 31, comprising following by way of a monitoring device with laser levels the movement of the solid structure of the wall system along directions that are substantially perpendicular to the planes of arrangement of the two larger faces of the solid structure of the wall system.

33. The method according to claim 1, comprising preliminary interventions to limit escape of said substance from outlets of said cavities that lead out of the solid structure of the wall system.

34. The method according to claim 33, wherein said preliminary interventions consist in performing column-type injections of a substance that expands by chemical reaction in the soil directly in the interface between the soil and the wail system and/or in regions of the ground that are spaced from the wall system.

35. The method according to claim 33, wherein said preliminary interventions consist in applying a sheet of geotextile fabric to the surface of the solid structure of the wall system where said outlets of the cavities are present and in performing a spray covering of said fabric with a substance that expands by chemical reaction.

36. A method for repairing, waterproofing, insulating and reinforcing a wall system by restoring structural integrity thereof, the wall system comprising a solid aggregate structure consisting of blocks of material with a binder interposed therebetween, the solid structure extending between planes of arrangement of opposite surfaces thereof, the method consisting:

in locating existing cavities formed in said solid structure by disaggregation of the block material or binder;

in providing spaced injection holes that extend along substantially vertical directions within said solid structure of the wall system in a manner suitable to pass through said cavities that exist in the solid structure;

in inserting injection tubes in said injection holes;

in injecting in said injection holes, through said injection tubes which are gradually retracted upward during injection, a substance that expands after injection as a consequence of a chemical reaction, fills said cavities and the injection holes and restores the structural integrity of the solid structure.

37. A method for repairing, waterproofing, insulating and reinforcing a wall system by restoring structural integrity thereof, the wall system comprising a solid aggregate structure consisting of blocks of material with a binder interposed therebetween, the solid structure extending between planes of arrangement of opposite surfaces thereof, the method consisting:

in locating existing cavities formed in said solid structure by disaggregation of the block material or binder;

in providing spaced injection holes that extend along substantially vertical directions within said solid structure of the wall system in a manner suitable to pass through said cavities that exist in the solid structure;

in selecting an expandable substance suitable to expand as a consequence of a chemical reaction that before expansion has a permeability coefficient equal to 10-9 m/s and an average viscosity comprised between 200 and 300 in mPa·s at 20° C.;

in inserting injection tubes in said injection holes;

in injecting in said injection boles, through said injection tubes which are gradually refracted upward during injection, a substance that expands after injection as a consequence of a chemical reaction, fills said cavities and the injection holes and restores the structural integrity of the solid structure.

* * * * *